US010415420B2

(12) United States Patent
Wasserman et al.

(10) Patent No.: US 10,415,420 B2
(45) Date of Patent: Sep. 17, 2019

(54) THERMAL LIFTING MEMBER FOR BLADE OUTER AIR SEAL SUPPORT

(71) Applicant: United Technologies Corporation, Farmington, CT (US)

(72) Inventors: David J. Wasserman, Hamden, CT (US); Scott D. Virkler, Ellington, CT (US); Eric A. Hudson, Harwinton, CT (US); Ryan W. Brandt, Jupiter, FL (US)

(73) Assignee: UNITED TECHNOLOGIES CORPORATION, Farmington, CT (US)

( * ) Notice: Subject to any disclaimer, the term of this patent is extended or adjusted under 35 U.S.C. 154(b) by 733 days.

(21) Appl. No.: 15/093,972

(22) Filed: Apr. 8, 2016

(65) Prior Publication Data

US 2017/0292398 A1 Oct. 12, 2017

(51) Int. Cl.
*F01D 11/24* (2006.01)
*F01D 5/12* (2006.01)
(Continued)

(52) U.S. Cl.
CPC ..... *F01D 11/24* (2013.01); *F01D 5/12* (2013.01); *F01D 11/14* (2013.01); *F01D 11/18* (2013.01); *F01D 25/24* (2013.01); *F05D 2220/32* (2013.01); *F05D 2240/55* (2013.01); *F05D 2260/2212* (2013.01); *F05D 2260/22141* (2013.01)

(58) Field of Classification Search
CPC ..... F01D 11/24; F01D 11/14
See application file for complete search history.

(56) References Cited

U.S. PATENT DOCUMENTS 5,116,199 A * 5/1992 Ciokajlo ..... F01D 11/24 415/116
5,219,268 A * 6/1993 Johnson ..... F01D 11/24 415/115

(Continued)

FOREIGN PATENT DOCUMENTS

EP 0541325 A1 5/1993
GB 2169962 A 7/1986

OTHER PUBLICATIONS

European Search Report, European Application No. 17165183.9, dated Sep. 20, 2017, European Patent Office; European Search Report 7 pages.

*Primary Examiner* — Justin D Seabe
*Assistant Examiner* — Jason A Fountain
(74) *Attorney, Agent, or Firm* — Cantor Colburn LLP

(57) ABSTRACT

Thermal lifting members for blade outer air seal supports of gas turbine engines include a hollow body defining a thermal cavity therein, at least one inlet fluid connector fluidly connected to the thermal cavity configured to supply hot fluid to the thermal cavity from a fluid source, at least one outlet fluid connector fluidly connected to the thermal cavity configured to allow the hot fluid to exit the thermal cavity, and at least one lifting hook configured to engage with a blade outer air seal support, wherein the thermal lifting member is configured to thermally expand outward when hot fluid is passed through the thermal cavity such that during thermal expansion the at least one lifting hook forces the blade outer air seal support to move outward.

22 Claims, 5 Drawing Sheets

(51) Int. Cl.

| | |
|---|---|
| ***F01D 25/24*** | (2006.01) |
| ***F01D 11/14*** | (2006.01) |
| ***F01D 11/18*** | (2006.01) |

(56) References Cited

U.S. PATENT DOCUMENTS

| | | | | |
|---|---|---|---|---|
| 5,906,473 | A | 5/1999 | Sexton et al. | |
| 6,935,836 | B2 * | 8/2005 | Ress, Jr. | F01D 11/025 415/173.2 |
| 7,347,661 | B2 * | 3/2008 | Phipps | F01D 25/14 415/108 |
| 9,574,455 | B2 * | 2/2017 | McCaffrey | F01D 11/127 |
| 2005/0238480 | A1 * | 10/2005 | Phipps | F01D 25/14 415/115 |
| 2016/0312643 | A1 * | 10/2016 | Davis | F01D 11/18 |

* cited by examiner

THERMAL LIFTING MEMBER FOR BLADE OUTER AIR SEAL SUPPORT

BACKGROUND

The subject matter disclosed herein generally relates to blade outer air seals in gas turbine engines and, more particularly, to thermal lifting members for blade outer air seal supports.

Rotor tip clearance is essential to turbomachinery efficiency and fuel consumption, particular in gas turbine engines. It is desirable to minimize the clearance between rotating blade tips and static outer shroud seals (e.g., blade outer air seals). This is currently accomplished in gas turbine engines with active clearance control (ACC), which uses cool air to impinge on the case and control thermal expansion, thus keeping the outer shrouds at a smaller diameter and reducing the clearance to the blade. In aerospace applications, ACC is traditionally employed during a cruise portion of flight of an aircraft. A conventional ACC system is governed by the thermal response of the components and the time constant is generally too slow to use in rapid throttle applications. For instance, if a hot reacceleration is performed, there is a danger of excessive rubbing of the blade tip. The rotor would immediately add the mechanical growth of the acceleration to the existing thermal growth of the hot disk, whereas the case structure would not be able to heat up sufficiently quickly to get out of the way. Accordingly, it is desirable to control rotor blade interaction with static outer shroud seals.

SUMMARY

According to one embodiment, a thermal lifting member for a blade outer air seal support of a gas turbine engine is provided. The thermal lifting member includes a hollow body defining a thermal cavity therein, at least one inlet fluid connector fluidly connected to the thermal cavity configured to supply hot fluid to the thermal cavity from a fluid source, at least one outlet fluid connector fluidly connected to the thermal cavity configured to allow the hot fluid to exit the thermal cavity, and at least one lifting hook configured to engage with a blade outer air seal support. The thermal lifting member is configured to thermally expand outward when hot fluid is passed through the thermal cavity such that during thermal expansion the at least one lifting hook forces the blade outer air seal support to move outward.

In addition to one or more of the features described above, or as an alternative, further embodiments of the thermal lifting member may include one or more internal features within the thermal cavity configured to at least one of increase heat transfer within the hollow body or provide fluid flow augmentation within the thermal cavity.

In addition to one or more of the features described above, or as an alternative, further embodiments of the thermal lifting member may include that the one or more internal features comprises trip strips, pedestals, pin fins, turbulators, or blade fins.

In addition to one or more of the features described above, or as an alternative, further embodiments of the thermal lifting member may include a radial spline configured to engage with a case slot of a case of a gas turbine engine.

In addition to one or more of the features described above, or as an alternative, further embodiments of the thermal lifting member may include a slip joint connecting the at least one inlet fluid connector to the hollow body.

In addition to one or more of the features described above, or as an alternative, further embodiments of the thermal lifting member may include that the at least one outlet fluid connector is positioned 180° from the at least one inlet fluid connector.

In addition to one or more of the features described above, or as an alternative, further embodiments of the thermal lifting member may include that the at least one inlet fluid connector comprises a first inlet fluid connector and a second inlet fluid connector and the at least one outlet fluid connector comprises a first outlet fluid connector and a second outlet fluid connector, that the first inlet fluid connector is positioned 180° from the second inlet fluid connector, that the first outlet fluid connector is positioned 180° from the second outlet fluid connector, and that the first inlet fluid connector is position 90° from the first outlet fluid connector.

In addition to one or more of the features described above, or as an alternative, further embodiments of the thermal lifting member may include that the hollow body is circular.

According to another embodiment, a blade outer air seal assembly is provided. The blade outer air seal support assembly includes a blade outer air seal support having a support body defining an inner cavity, at least one first support hook configured to engage with a blade outer air seal, at least one second support hook configured to engage with a case hook of a case of a gas turbine engine, and at least one loading hook within the inner cavity. The assembly also includes a thermal lifting member disposed within the inner cavity of the support body having a hollow body defining a thermal cavity therein, at least one inlet fluid connector fluidly connected to the thermal cavity configured to supply hot fluid to the thermal cavity from a fluid source, at least one outlet fluid connector fluidly connected to the thermal cavity configured to allow the hot fluid to exit the thermal cavity, and at least one lifting hook configured to engage with the at least one loading hook within the inner cavity of the support body. The thermal lifting member is configured to thermally expand outward when hot fluid is passed through the thermal cavity such that during thermal expansion the at least one lifting hook applies force to the at least one loading hook to force the blade outer air seal support radially outward.

In addition to one or more of the features described above, or as an alternative, further embodiments of the blade outer air seal assembly may include one or more internal features within the thermal cavity configured to at least one of increase heat transfer within the hollow body or provide fluid flow augmentation within the thermal cavity.

In addition to one or more of the features described above, or as an alternative, further embodiments of the blade outer air seal assembly may include that the one or more internal features comprises trip strips, pedestals, pin fins, turbulators, or blade fins.

In addition to one or more of the features described above, or as an alternative, further embodiments of the blade outer air seal assembly may include that the thermal lifting member further includes a radial spline configured to engage with a case slot of a case of a gas turbine engine.

In addition to one or more of the features described above, or as an alternative, further embodiments of the blade outer air seal assembly may include that the thermal lifting member further includes a slip joint connecting the at least one inlet fluid connector to the hollow body.

In addition to one or more of the features described above, or as an alternative, further embodiments of the blade outer air seal assembly may include that the at least one outlet fluid connector is positioned 180° from the at least one inlet fluid connector.

In addition to one or more of the features described above, or as an alternative, further embodiments of the blade outer air seal assembly may include that the at least one inlet fluid connector comprises a first inlet fluid connector and a second inlet fluid connector and the at least one outlet fluid connector comprises a first outlet fluid connector and a second outlet fluid connector, that the first inlet fluid connector is positioned 180° from the second inlet fluid connector, that the first outlet fluid connector is positioned 180° from the second outlet fluid connector, and that the first inlet fluid connector is position 90° from the first outlet fluid connector.

In addition to one or more of the features described above, or as an alternative, further embodiments of the blade outer air seal assembly may include a blade outer air seal engaged with the at least one first support hook.

In addition to one or more of the features described above, or as an alternative, further embodiments of the blade outer air seal assembly may include a hot fluid source configured to supply hot fluid to the thermal cavity.

In addition to one or more of the features described above, or as an alternative, further embodiments of the blade outer air seal assembly may include a valve operably positioned between the hot fluid source and the thermal cavity, the valve operably controllable to supply hot fluid to the thermal cavity.

In addition to one or more of the features described above, or as an alternative, further embodiments of the blade outer air seal assembly may include that the hollow body is circular.

According to another embodiment, a gas turbine engine is provided. The gas turbine engine includes a case configured to house components of the gas turbine engine, a blade outer air seal support assembly including a blade outer air seal support having a support body defining an inner cavity, at least one first support hook configured to engage with a blade outer air seal, at least one second support hook configured to engage with a case hook of the case, and at least one loading hook within the inner cavity, and a thermal lifting member disposed within the inner cavity of the support body having a hollow body defining a thermal cavity therein, at least one inlet fluid connector fluidly connected to the thermal cavity configured to supply hot fluid to the thermal cavity from a fluid source, at least one outlet fluid connector fluidly connected to the thermal cavity configured to allow the hot fluid to exit the thermal cavity, and at least one lifting hook configured to engage with the at least one loading hook within the inner cavity of the support body. The thermal lifting member is configured to thermally expand outward when hot fluid is passed through the thermal cavity such that during thermal expansion the at least one lifting hook applies force to the at least one loading hook to force the blade outer air seal support radially outward and a blade outer air seal engaged with the at least one first support hook of the blade outer air seal support.

In addition to one or more of the features described above, or as an alternative, further embodiments of the gas turbine engine may include one or more internal features within the thermal cavity configured to at least one of increase heat transfer within the hollow body or provide fluid flow augmentation within the thermal cavity.

In addition to one or more of the features described above, or as an alternative, further embodiments of the gas turbine engine may include a hot fluid source configured to supply hot fluid to the thermal cavity, a valve operably positioned between the hot fluid source and the thermal cavity, and a controller configured to operably control the valve to supply hot fluid to the thermal cavity.

Technical effects of embodiments of the present disclosure include a thermal lifting member configured to quickly and efficiently lift a blade outer air seal and/or blade outer air seal support such that thermal expansion of an airfoil does not impact the blade outer air seal. Further technical effects include a thermal lifting member configured to receive hot fluid to thermally expand and move a blade outer air seal support during an event that increases the blade tip radius in a gas turbine engine.

The foregoing features and elements may be executed or utilized in various combinations without exclusivity, unless expressly indicated otherwise. These features and elements as well as the operation thereof will become more apparent in light of the following description and the accompanying drawings. It should be understood, however, that the following description and drawings are intended to be illustrative and explanatory in nature and non-limiting.

BRIEF DESCRIPTION OF THE DRAWINGS

The subject matter is particularly pointed out and distinctly claimed at the conclusion of the specification. The foregoing and other features, and advantages of the present disclosure are apparent from the following detailed description taken in conjunction with the accompanying drawings in which:

DETAILED DESCRIPTION

Figure 1A:
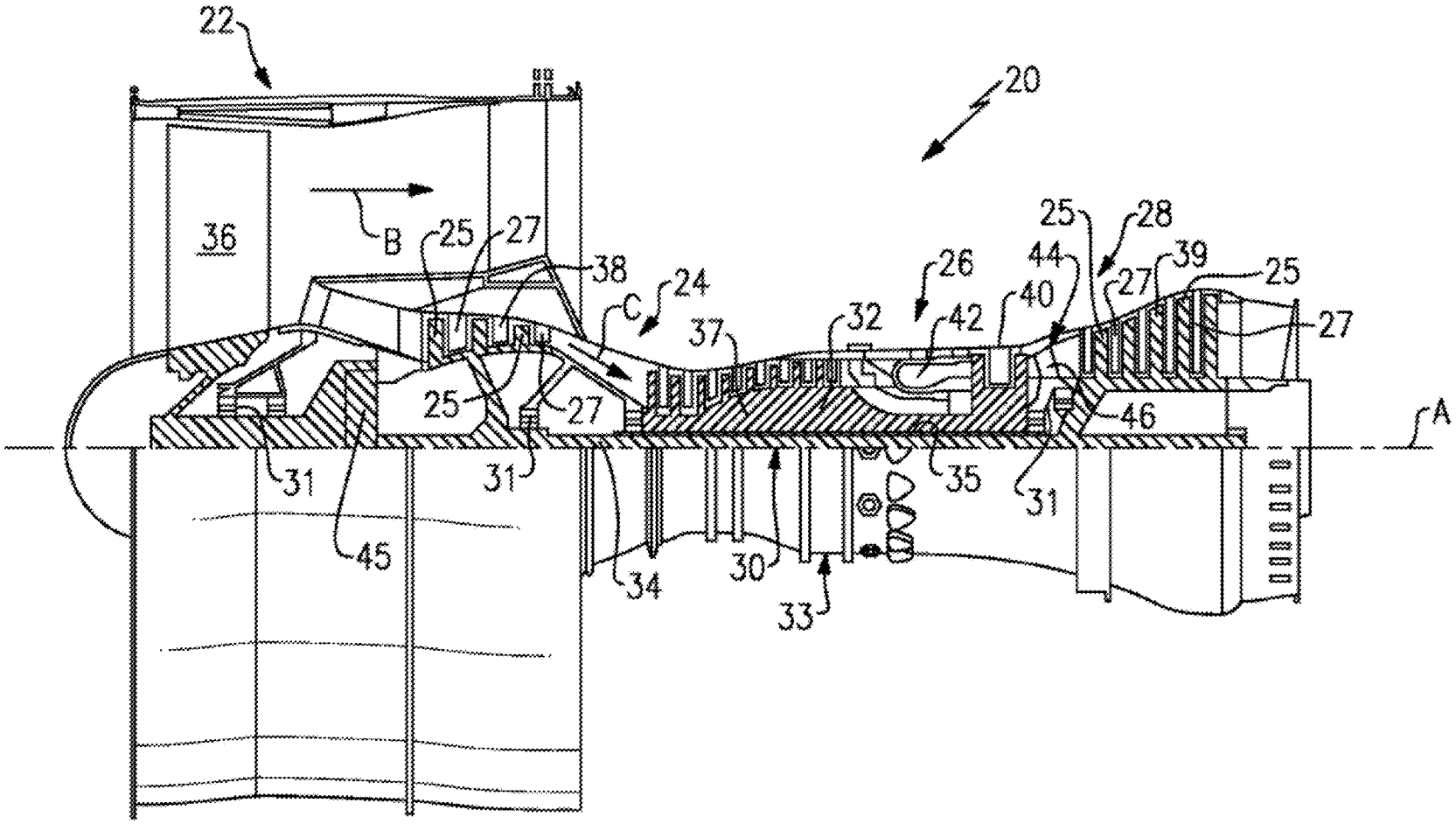
FIG. 1A is a schematic cross-sectional illustration of a gas turbine engine that may employ various embodiments disclosed herein.

As shown and described herein, various features of the disclosure will be presented. Various embodiments may have the same or similar features and thus the same or similar features may be labeled with the same reference numeral, but preceded by a different first number indicating the Figure Number to which the feature is shown. Thus, for example, element "a" that is shown in FIG. X may be labeled "Xa" and a similar feature in FIG. Z may be labeled "Za." Although similar reference numbers may be used in a generic sense, various embodiments will be described and various features may include changes, alterations, modifications, etc. as will be appreciated by those of skill in the art, whether explicitly described or otherwise would be appreciated by those of skill in the art.

FIG. 1A schematically illustrates a gas turbine engine 20. The exemplary gas turbine engine 20 is a two-spool turbofan engine that generally incorporates a fan section 22, a compressor section 24, a combustor section 26, and a turbine section 28. Alternative engines might include an augmenter section (not shown) among other systems for features. The fan section 22 drives air along a bypass flow path B, while the compressor section 24 drives air along a core flow path C for compression and communication into the combustor section 26. Hot combustion gases generated in the combustor section 26 are expanded through the turbine section 28. Although depicted as a turbofan gas turbine engine in the disclosed non-limiting embodiment, it should be understood that the concepts described herein are not limited to turbofan engines and these teachings could extend to other types of engines, including but not limited to, three-spool engine architectures.

The gas turbine engine 20 generally includes a low speed spool 30 and a high speed spool 32 mounted for rotation about an engine centerline longitudinal axis A. The low speed spool 30 and the high speed spool 32 may be mounted relative to an engine static structure 33 via several bearing systems 31. It should be understood that other bearing systems 31 may alternatively or additionally be provided.

The low speed spool 30 generally includes an inner shaft 34 that interconnects a fan 36, a low pressure compressor 38 and a low pressure turbine 39. The inner shaft 34 can be connected to the fan 36 through a geared architecture 45 to drive the fan 36 at a lower speed than the low speed spool 30. The high speed spool 32 includes an outer shaft 35 that interconnects a high pressure compressor 37 and a high pressure turbine 40. In this embodiment, the inner shaft 34 and the outer shaft 35 are supported at various axial locations by bearing systems 31 positioned within the engine static structure 33.

A combustor 42 is arranged between the high pressure compressor 37 and the high pressure turbine 40. A mid-turbine frame 44 may be arranged generally between the high pressure turbine 40 and the low pressure turbine 39. The mid-turbine frame 44 can support one or more bearing systems 31 of the turbine section 28. The mid-turbine frame 44 may include one or more airfoils 46 that extend within the core flow path C.

The inner shaft 34 and the outer shaft 35 are concentric and rotate via the bearing systems 31 about the engine centerline longitudinal axis A, which is co-linear with their longitudinal axes. The core airflow is compressed by the low pressure compressor 38 and the high pressure compressor 37, is mixed with fuel and burned in the combustor 42, and is then expanded over the high pressure turbine 40 and the low pressure turbine 39. The high pressure turbine 40 and the low pressure turbine 39 rotationally drive the respective high speed spool 32 and the low speed spool 30 in response to the expansion.

The pressure ratio of the low pressure turbine 39 can be pressure measured prior to the inlet of the low pressure turbine 39 as related to the pressure at the outlet of the low pressure turbine 39 and prior to an exhaust nozzle of the gas turbine engine 20. In one non-limiting embodiment, the bypass ratio of the gas turbine engine 20 is greater than about ten (10:1), the fan diameter is significantly larger than that of the low pressure compressor 38, and the low pressure turbine 39 has a pressure ratio that is greater than about five (5:1). It should be understood, however, that the above parameters are only examples of one embodiment of a geared architecture engine and that the present disclosure is applicable to other gas turbine engines, including direct drive turbofans.

In this embodiment of the example gas turbine engine 20, a significant amount of thrust is provided by the bypass flow path B due to the high bypass ratio. The fan section 22 of the gas turbine engine 20 is designed for a particular flight condition—typically cruise at about 0.8 Mach and about 35,000 feet. This flight condition, with the gas turbine engine 20 at its best fuel consumption, is also known as bucket cruise Thrust Specific Fuel Consumption (TSFC). TSFC is an industry standard parameter of fuel consumption per unit of thrust.

Fan Pressure Ratio is the pressure ratio across a blade of the fan section 22 without the use of a Fan Exit Guide Vane system. The low Fan Pressure Ratio according to one non-limiting embodiment of the example gas turbine engine 20 is less than 1.45. Low Corrected Fan Tip Speed is the actual fan tip speed divided by an industry standard temperature correction of $[(\text{Tram}\ ^\circ\ \text{R})/(518.7^\circ\ \text{R})]^{0.5}$, where T represents the ambient temperature in degrees Rankine. The Low Corrected Fan Tip Speed according to one non-limiting embodiment of the example gas turbine engine 20 is less than about 1150 fps (351 m/s).

Each of the compressor section 24 and the turbine section 28 may include alternating rows of rotor assemblies and vane assemblies (shown schematically) that carry airfoils that extend into the core flow path C. For example, the rotor assemblies can carry a plurality of rotating blades 25, while each vane assembly can carry a plurality of vanes 27 that extend into the core flow path C. The blades 25 of the rotor assemblies create or extract energy (in the form of pressure) from the core airflow that is communicated through the gas turbine engine 20 along the core flow path C. The vanes 27 of the vane assemblies direct the core airflow to the blades 25 to either add or extract energy.

Various components of a gas turbine engine 20, including but not limited to the airfoils of the blades 25 and the vanes 27 of the compressor section 24 and the turbine section 28, may be subjected to repetitive thermal cycling under widely ranging temperatures and pressures. The hardware of the turbine section 28 is particularly subjected to relatively extreme operating conditions. Therefore, some components may require internal cooling circuits for cooling the parts during engine operation. Example cooling circuits that include features such as airflow bleed ports are discussed below.

Figure 1B:
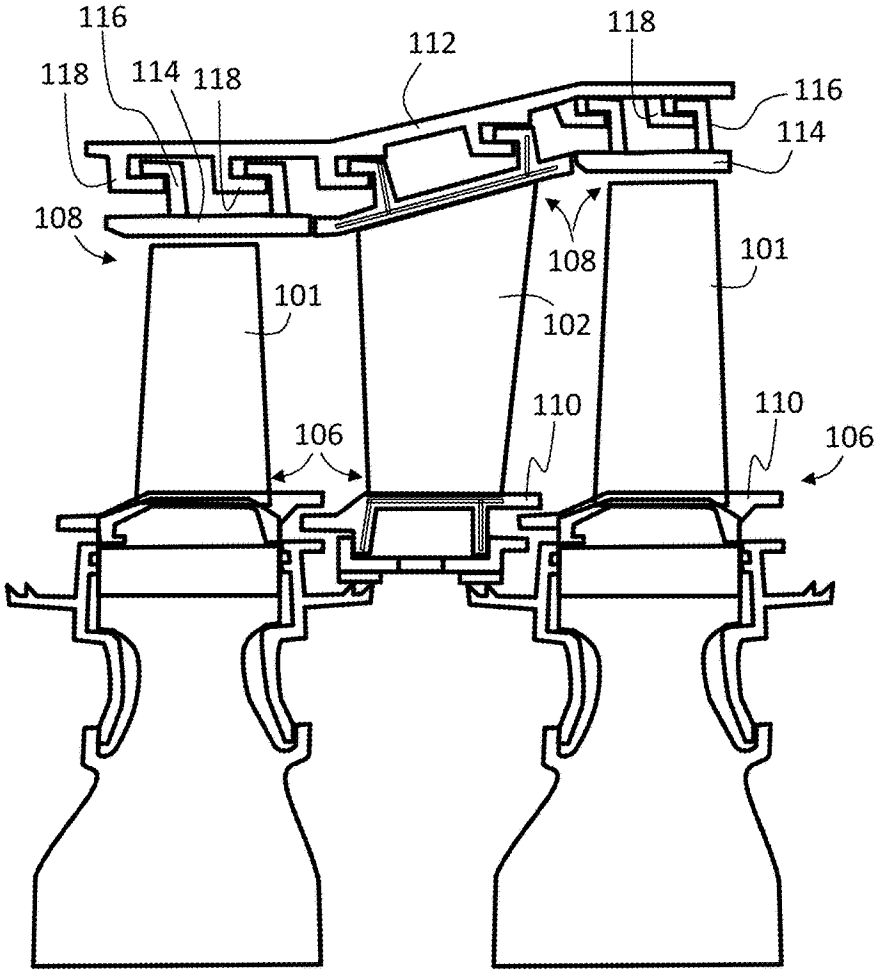
FIG. 1B is a schematic illustration of a turbine that may employ various embodiments disclosed herein.

FIG. 1B is a schematic view of a turbine section that may employ various embodiments disclosed herein. Turbine 100 includes a plurality of airfoils, including, for example, one or more blades 101 and vanes 102. The airfoils 101, 102 may be hollow bodies with internal cavities defining a number of channels or cavities, hereinafter airfoil cavities, formed therein and extending from an inner diameter 106 to an outer diameter 108, or vice-versa. The airfoil cavities may be separated by partitions within the airfoils 101, 102 that may extend either from the inner diameter 106 or the outer diameter 108 of the airfoil 101, 102. The partitions may extend for a portion of the length of the airfoil 101, 102, but may stop or end prior to forming a complete wall within the airfoil 101, 102. Thus, each of the airfoil cavities may be fluidly connected and form a fluid path within the respective airfoil 101, 102. The blades 101 and the vanes may include platforms 110 located proximal to the inner diameter thereof. Located below the platforms 110 may be airflow ports and/or bleed orifices that enable air to bleed from the internal cavities of the airfoils 101, 102. A root of the airfoil may connected to or be part of the platform 110.

The turbine 100 is housed within a case 112, which may have multiple parts (e.g., turbine case, diffuser case, etc.). In various locations, components, such as seals, may be positioned between airfoils 101, 102 and the case 112. For example, as shown in FIG. 1B, a blade outer air seals 114

(hereafter "BOAS") are located radially outward from the blades 101. Those of skill in the art will appreciate that the BOAS 114, in some configurations, may be formed of a plurality of seal segments. The BOAS 114 include BOAS supports 116 that are configured to fixedly connect or attached the BOAS 114 to the case 112. The case 112 includes a plurality of hooks 118 that engage with the BOAS supports 116 to secure the BOAS 114 between the case 112 and a tip of the blade 101.

In traditional gas turbine engine configurations, a first stage BOAS is directly aft of a combustor and is exposed to high temperatures expelled therefrom. Accordingly, the first stage BOAS can be a life limiting part of the gas turbine engine and may require replacement more often than surrounding parts (or other parts in the gas turbine engine). Replacing the first stage BOAS can be difficult and/or expensive due to the placement within the gas turbine engine and the steps required to remove the case surrounding the turbine section and providing access to the BOAS. Accordingly, enabling easy or efficient access to BOAS can decrease maintenance costs and/or reduce maintenance times.

Figure 2:
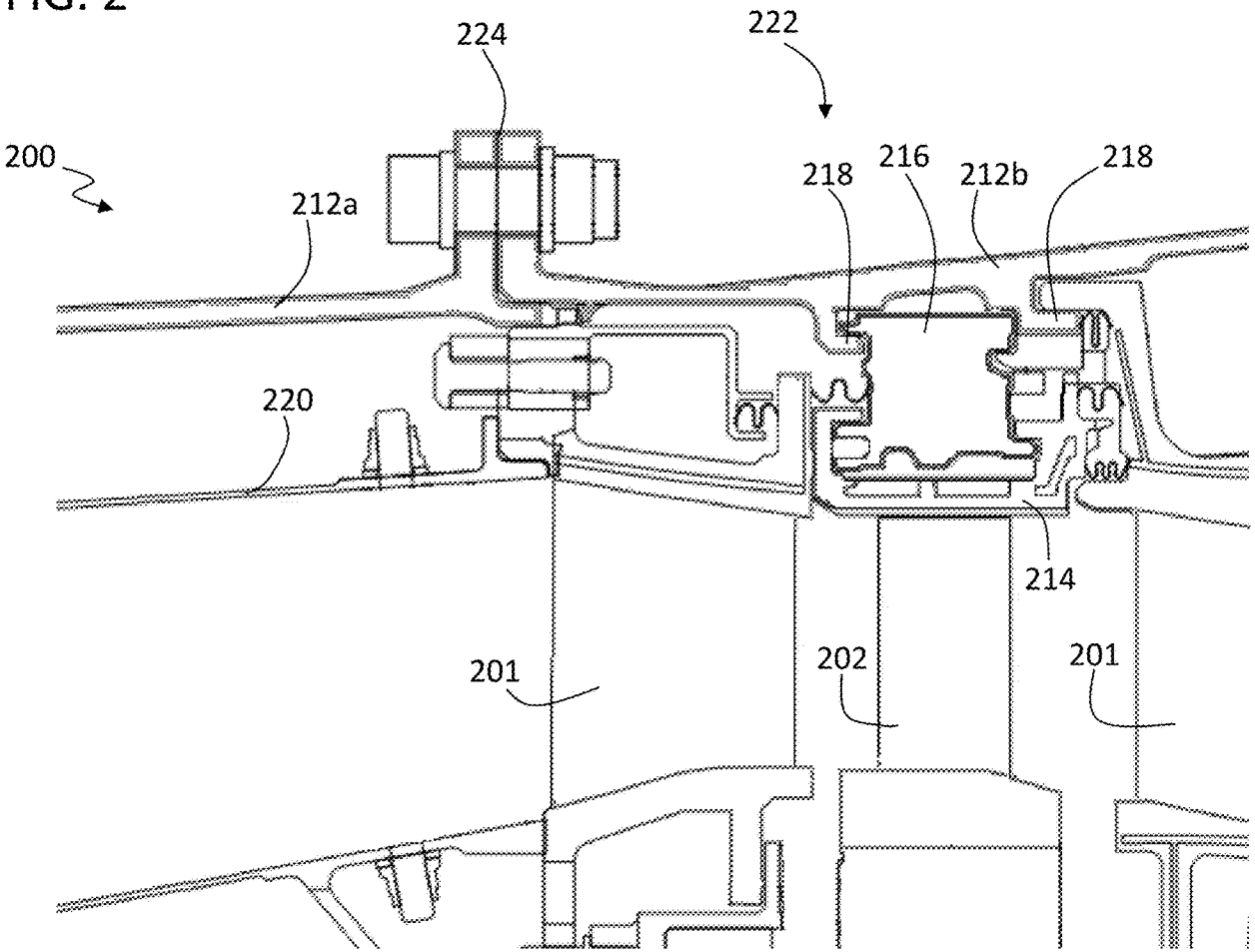
FIG. 2 is a schematic illustration of a blade outer air seal and associated support in a gas turbine engine.

For example, turning to FIG. 2, a schematic illustration of a portion of a turbine 200 is shown. The turbine 200 includes a combustor 220 housed within a diffuser case 212*a*. Aft of the combustor 220 is a turbine section 222 such as a high pressure turbine. The turbine section 222 includes a plurality of airfoils 201, 202 housed within a turbine case 212*b*. The diffuser case 212*a* and the turbine case 212*b* are fixedly connected at a joint 224 and form a portion of a case that houses a gas turbine engine.

The turbine case 212*b* includes one or more hooks 218 extending radially inward from an inner surface thereof that are configured to receive components of the turbine 200. For example, one or more case hooks 218 can receive a BOAS support 216 that is located radially outward from a blade 202. The BOAS support 216 supports a BOAS 214 that is located between the BOAS support 216 and a tip of the blade 202.

Tip clearance of the blade 202, e.g., clearance between the blade 202 and the BOAS 214, is essential for efficiency in turbine 200. It is desirable to minimize the clearance between the tip of the blade 202 and the BOAS 214. This is accomplished in some configurations with active clearance control (ACC), which uses cool air to impinge on the turbine case 212*b* and control thermal expansion, thus keeping the BOAS 214 at a smaller diameter and reducing the clearance to the tip of the blade 202. A conventional ACC system is governed by the thermal response of the components (e.g., blade 202, BOAS 214, BOAS support 216, etc.) and the time constant is generally too slow to use in rapid throttle applications. Embodiments provided herein are directed to enabling the BOAS and/or BOAS seal to quickly react to thermal expansion, and thus prevent contact between a tip of a blade and a BOAS.

Figure 3:
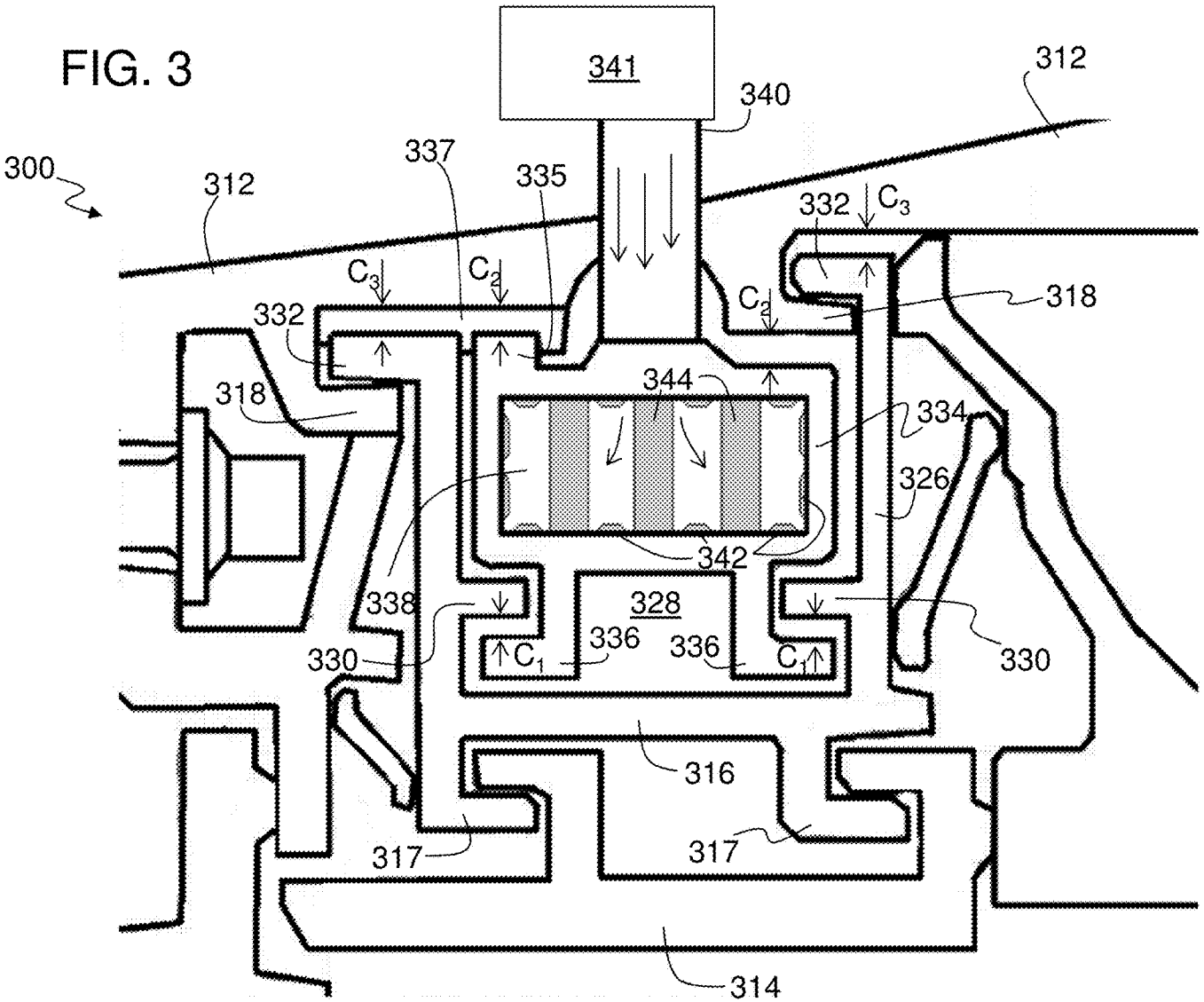
FIG. 3 is a schematic illustration of a thermal lifting member in accordance with an embodiment of the present disclosure as positioned within a gas turbine engine.

For example, turning to FIG. 3, an enlarged schematic illustration of a turbine including a non-limiting embodiment of the present disclosure is shown. FIG. 3 shows a section of turbine 300 having a BOAS 314 supported by and connected to a BOAS support 316 in accordance with an embodiment of the present disclosure. The BOAS support 316 connects with the BOAS 314 with first support hooks 317. The BOAS support 316 is configured to engage with case hooks 318 of a case 312 of the turbine 300 with second support hooks 332. Various other parts and/or components, including flanges, seals, etc. are shown but not described as they are readily known to those of skill in the art.

As shown, the BOAS support 316 includes a support body 326 defining an inner cavity 328. The support body 326 of the BOAS support 316 includes at least one loading hook 330 that extends into the inner cavity 328 of the BOAS support 316. The support body 326 further includes at least one second support hook 332 configured to engage with a corresponding case hook 318.

As shown, disposed within the inner cavity 328 of the BOAS support 316 is a thermal lifting member 334. In one non-limiting, example embodiment, the thermal lifting member 334 is a full hoop, free-floating, hollow body. The hollow body of the thermal lifting member 334 can be configured as a circle (e.g., a ring that is radially splined into the case 312) or other shape, including but not limited to, polygonal shapes (e.g., an n-sided shape wherein n=the number of segments of BOAS). As shown, a radial spline 335 engages with a case slot 337. The thermal lifting member 334, in some embodiments, is made from a high alpha material and uses rapid thermal expansion to engage lifting hooks 336 with the loading hooks 330 of the BOAS support 316 to lift the BOAS support 316 and the BOAS 314 radially outboard to avoid rub by turbine blades.

The radial spline 335 allows the thermal lifting member 334 to thermally expand and contract independent of the case 312, while keeping the thermal lifting member 334 concentric with an engine centerline. During normal operation the BOAS 314 is loaded radially inboard on the first support hooks 317 of the BOAS support 316, which in turn are loaded on the case hooks 318 of the case 312. As such, the radial positions of the BOAS 314 are generally controlled by thermal growth of the case 312. The lifting hooks 336 attached to the thermal lifting member 334 have a first radial clearance $C_1$ with respect to the loading hooks 330 of the BOAS support 316. The lifting hooks 336 do not engage with the loading hooks 330 during normal steady state operation.

When it is necessary to lift the BOAS 314 out of the way of a blade tip, such as during a hot re-acceleration, hot air is introduced into a thermal cavity 338 within the thermal lifting member 334. The thermal cavity 338 of the thermal lifting member 334 is fluidly connected to a hot air source 341 via at least one inlet fluid connector 340. The inlet fluid connector 340 can be attached to an outer diameter of the thermal lifting member 334 at a particular angular location. Air travels through the thermal cavity 338 and is exhausted to a lower pressure sink via an outlet fluid connector (not shown, but similar to the inlet fluid connector 340) located at a different angular location.

The thermal cavity 338 of the thermal lifting member 334, in some embodiments and as shown in FIG. 3, contains internal features or elements configured to enable and/or increase heat transfer and/or fluid flow augmentation within the thermal cavity 338 as fluid flows from the inlet fluid connector 340 to an outlet fluid connector. Such internal features may include, but are not limited to, trip strips 342, pedestals 344, pin fins, turbulators, blade fins, and/or other thermal transfer and/or flow augmentation features. The internal features increase the surface area of the walls of the thermal cavity 338 and/or increase the convective heat transfer coefficient in the thermal cavity 338. Such features enable the thermal lifting member 334 to respond quickly to thermal changes, and specifically respond faster than a thermal response of the case 312.

As hot fluid is pumped into the thermal lifting member 334, the thermal lifting member 334 rapidly expands in diameter. As the thermal lifting member 334 expands in diameter due to thermal expansion, the lifting hooks 336 engage the loading hooks 330 of the BOAS support 316 and unloading the first support hooks 317 that engage with the BOAS 314. That is, the first radial clearance $C_1$ decreases and then is eliminated as the lifting hooks 336 engaged with the loading hooks 330. The BOAS support 316 then pulls the BOAS 314 radially outboard, thus increasing a tip clearance between the BOAS 314 and a tip of a blade (not shown) and avoiding rub.

As shown in FIG. 3, proximate to an interior surface of the case 312 the thermal lifting member 334 is separated from the interior surface of the case 312 by a second radial clearance $C_2$. The second radial clearance $C_2$ provides a gap such that the thermal lifting member 334 can expand radially outward without contacting the case 312. The second radial clearance $C_2$ also enables the thermal lifting member 334 to not interfere with operation of the BOAS support 316 and/or BOAS 314 during normal operating conditions. Further, as shown, the BOAS support 316 has a third radial clearance $C_3$ located radially outward from the second support hooks 332 of the BOAS support 316. The third radial clearance $C_3$ enables the BOAS support 316 to be lifted radially outboard from a normal position or state (e.g., when second support hooks 332 are engaged with case hooks 318). Thus, the BOAS support 326 have radial clearance to be pulled outboard by the thermal lifting member 334 and thereby pull the BOAS 314 outboard away from a tip of a blade.

During normal operation, e.g., when the thermal lifting member 334 is not actively pulling the BOAS support 316 outboard, cooling air can be supplied between the thermal lifting member 334 and the interior surface of the BOAS support 316. That is, cooling air can be supplied within the inner cavity 328 of the BOAS support and around the thermal lifting member 334. Such cooling air can be actively applied after a thermal expansion event wherein the thermal lifting member 334 is in an expanded state. The cooling air will cause the thermal lifting member 334 to contract, and thus release the BOAS support 316 and BOAS 314 back to a normal operating state.

Figure 5:
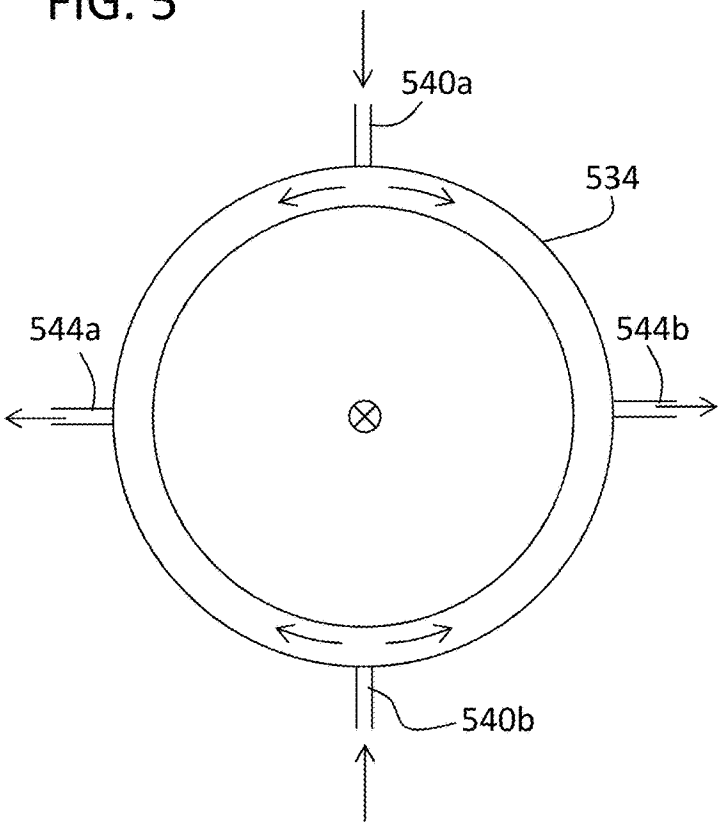
FIG. 5 is a schematic illustration of another configuration of a thermal lifting member in accordance with a non-limiting embodiment of the present disclosure.
Figure 4:
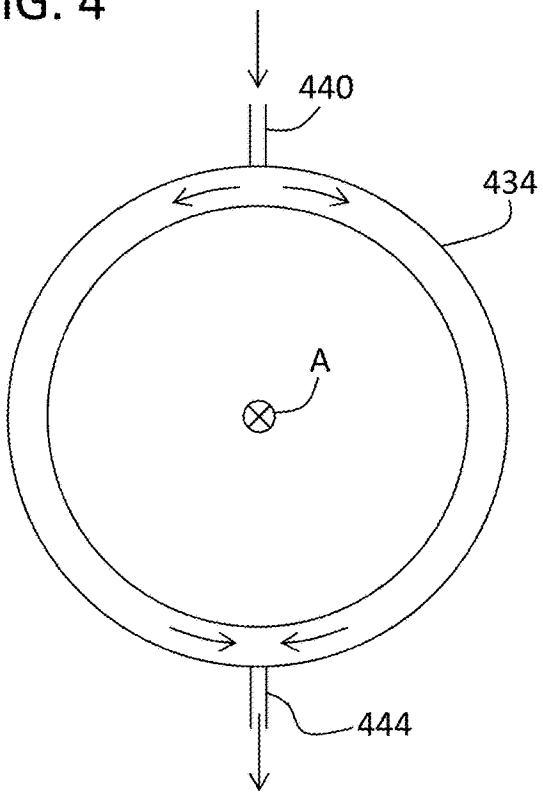
FIG. 4 is a schematic illustration of a thermal lifting member in accordance with a non-limiting embodiment of the present disclosure.

Turning now to FIGS. 4-5, schematic illustrations of thermal lifting members in accordance with various embodiments of the present disclosure are shown. FIG. 4 shows a thermal lifting member 434 having one inlet fluid connector 440 and one outlet fluid connector 444. The arrows in FIG. 4 indicated a hot fluid flow into the inlet fluid connector 440, through the thermal lifting member 434, and then out an outlet fluid connector 444. As shown, the inlet fluid connector 440 is configured 180° from the outlet fluid connector 444 about the thermal lifting member 434. Also shown in FIG. 4 is an engine axis A. When hot fluid is passed through the thermal lifting member 434, the thermal lifting member 434 expands radially outward from the engine axis A.

Turning to FIG. 5, and alternative configuration of a thermal lifting member in accordance with an embodiment of the present disclosure is shown. In FIG. 5, a thermal lifting member 534 includes two inlet fluid connectors 540*a*, 540*b* spaced 180° apart. Further, the thermal lifting member 534 includes two outlet fluid connectors 544*a*, 544*b* spaced 180° apart. The inlet fluid connectors 540*a*, 540*b* are clocked or spaced 90° relative to the outlet fluid connectors 544*a*, 544*b*.

Although FIGS. 4-5 provide two example configurations of thermal lifting members in accordance with the present disclosure, those of skill in the art will appreciate that other configurations are possible without departing from the scope of the present disclosure. For example, any number of inlet and/or outlet fluid connectors could be used.

In any of the above described embodiments, and/or variations thereon, the supply of hot fluid into and through the thermal lifting member can be controlled to operate only when desired. Accordingly, in some embodiments, a controller can be configured to control one or more valves that are opened when it is desired that the BOAS be pulled radially outboard and away from a tip of a blade. For example, in aerospace applications, a controller may be a computer or controller associated with and/or in communication with a throttle controller or other element such that when predefined conditions of engine operation are detected (e.g., hot reacceleration) a valve is opened to allow for hot fluid to flow into the thermal cavity of the thermal lifting member. In one non-limiting embodiment, for example, a fluid connector can fluidly connect the thermal cavity of the thermal lifting member with the combustor or other hot-section of the engine. One or more valves can be configured within the fluid connector, and when desired, the valve can open hot air can be bled from the hot source to thermally impact the thermal lifting member.

In some embodiments, the inlet and/or outlet fluid connectors are integrally formed with and/or attached to the thermal lifting member. However, in other embodiments, the inlet and/or outlet fluid connectors can be movably retained and/movably connected to the thermal lifting member. For example, a slip joint may be used in the connection between the fluid connectors and the thermal lifting member such that the thermal lifting member can thermally expand and/or contract independent from the fluid connectors.

In accordance with some non-limiting embodiments, the thermal lifting member is additively manufactured to enable complex internal geometries, including trip strips, pedestals, pin fins, turbulators, blade fins, and/or other thermal transfer and/or flow augmentation features. In other embodiments, the thermal lifting member can be produced by investment casting, machining, and/or welded assemblies.

Advantageously, embodiments provided herein enable a rapid response of a thermal lifting member to lift a blade outer air seal to avoid tip rub. Further, embodiments provided herein, when employed in a high pressure turbine, can enable an overall reduction in steady state tip clearance, resulting in up to ~3% high pressure turbine efficiency improvement. Further, advantageously, embodiments provided herein can be additively manufactured to produce complex internal geometries for heat transfer augmentation and contain no moving parts such as linkages, gears, cams, etc. that are subject to wear and failure. Further, embodiments provided herein require no actuators to move the BOAS to a desired position. Moreover, embodiments provided herein can be packaged fairly easily and superimposed onto existing active clearance control systems.

The use of the terms "a," "an," "the," and similar references in the context of description (especially in the context of the following claims) are to be construed to cover both the singular and the plural, unless otherwise indicated herein or specifically contradicted by context. The modifier "about" used in connection with a quantity is inclusive of the stated value and has the meaning dictated by the context (e.g., it includes the degree of error associated with measurement of the particular quantity). All ranges disclosed herein are inclusive of the endpoints, and the endpoints are independently combinable with each other.

While the present disclosure has been described in detail in connection with only a limited number of embodiments, it should be readily understood that the present disclosure is not limited to such disclosed embodiments. Rather, the present disclosure can be modified to incorporate any number of variations, alterations, substitutions, combinations, sub-combinations, or equivalent arrangements not heretofore described, but which are commensurate with the scope of the present disclosure. Additionally, while various embodiments of the present disclosure have been described, it is to be understood that aspects of the present disclosure may include only some of the described embodiments.

For example, although an aero or aircraft engine application is shown and described above, those of skill in the art will appreciate that airfoil configurations as described herein may be applied to industrial applications and/or industrial gas turbine engines, land based or otherwise. Further, although certain configurations (e.g., BOAS, BOAS supports, and thermal lifting members) are shown and described herein, those of skill in the art will appreciate that other shapes, sizes, geometries, etc. can be employed without departing from the scope of the present disclosure.

Accordingly, the present disclosure is not to be seen as limited by the foregoing description, but is only limited by the scope of the appended claims.

What is claimed is:

1. A thermal lifting member for a blade outer air seal support of a gas turbine engine comprising:

a free-floating, hollow body defining a thermal cavity therein, wherein the free-floating, hollow body is free-floating when installed within the gas turbine engine;

at least one inlet fluid connector fluidly connected to the thermal cavity configured to supply hot fluid to the thermal cavity from a fluid source;

at least one outlet fluid connector fluidly connected to the thermal cavity configured to allow the hot fluid to exit the thermal cavity;

at least one lifting hook extending from the free-floating, hollow body and configured to engage with the blade outer air seal support, and a slip joint connecting the at least one inlet fluid connector to the hollow body, wherein the thermal lifting member is configured to thermally expand outward and freely move when hot fluid is passed through the thermal cavity such that during thermal expansion the at least one lifting hook engages the blade outer air seal support to urge the blade outer air seal support outward.

2. The thermal lifting member of claim 1, further comprising one or more internal features within the thermal cavity configured to at least one of increase heat transfer within the hollow body or provide fluid flow augmentation within the thermal cavity.

3. The thermal lifting member of claim 2, wherein the one or more internal features comprises trip strips, pedestals, pin fins, turbulators, or blade fins.

4. The thermal lifting member of claim 1, further comprising a radial spline configured to engage with a case slot of a case of the gas turbine engine.

5. The thermal lifting member of claim 1, wherein the at least one outlet fluid connector is positioned 180° from the at least one inlet fluid connector.

6. The thermal lifting member of claim 1, wherein the at least one inlet fluid connector comprises a first inlet fluid connector and a second inlet fluid connector and the at least one outlet fluid connector comprises a first outlet fluid connector and a second outlet fluid connector, wherein the first inlet fluid connector is positioned 180° from the second inlet fluid connector, wherein the first outlet fluid connector is positioned 180° from the second outlet fluid connector; and wherein the first inlet fluid connector is position 90° from the first outlet fluid connector.

7. The thermal lifting member of claim 1, wherein the hollow body is circular.

8. A blade outer air seal support assembly of a gas turbine engine comprising:

a blade outer air seal support having:

a support body defining an inner cavity;

at least one first support hook configured to engage with a blade outer air seal;

at least one second support hook configured to engage with a case hook of a case; and at least one loading hook within the inner cavity; and a thermal lifting member disposed within the inner cavity of the support body having:

a free floating, hollow body defining a thermal cavity therein, wherein the free-floating, hollow body is free-floating relative to the inner cavity of the support body when installed within the inner cavity of the support body;

at least one inlet fluid connector fluidly connected to the thermal cavity configured to supply hot fluid to the thermal cavity from a fluid source;

at least one outlet fluid connector fluidly connected to the thermal cavity configured to allow the hot fluid to exit the thermal cavity; and at least one lifting hook extending from the free-floating, hollow body and configured to engage with the at least one loading hook within the inner cavity of the support body, wherein the thermal lifting member is configured to thermally expand outward and freely move when hot fluid is passed through the thermal cavity such that during thermal expansion the at least one lifting hook applies force to the at least one loading hook to engage the blade outer air seal support and urge the blade outer air seal support radially outward.

9. The blade outer air seal support assembly of claim 8, further comprising one or more internal features within the thermal cavity configured to at least one of increase heat transfer within the hollow body or provide fluid flow augmentation within the thermal cavity.

10. The blade outer air seal support assembly of claim 9, wherein the one or more internal features comprises trip strips, pedestals, pin fins, turbulators, or blade fins.

11. The blade outer air seal support assembly of claim 8, the thermal lifting member further comprising a radial spline configured to engage with a case slot of a case.

12. The blade outer air seal support assembly of claim 8, the thermal lifting member further comprising a slip joint connecting the at least one inlet fluid connector to the hollow body.

13. The blade outer air seal support assembly of claim 8, wherein the at least one outlet fluid connector is positioned 180° from the at least one inlet fluid connector.

14. The blade outer air seal support assembly of claim 8, wherein the at least one inlet fluid connector comprises a first inlet fluid connector and a second inlet fluid connector and the at least one outlet fluid connector comprises a first outlet fluid connector and a second outlet fluid connector, wherein the first inlet fluid connector is positioned 180° from the second inlet fluid connector, wherein the first outlet fluid connector is positioned 180° from the second outlet fluid connector; and wherein the first inlet fluid connector is position 90° from the first outlet fluid connector.

15. The blade outer air seal support assembly of claim 8, further comprising a blade outer air seal engaged with the at least one first support hook.

16. The blade outer air seal support assembly of claim 8, further comprising a hot fluid source configured to supply hot fluid to the thermal cavity.

17. The blade outer air seal support assembly of claim 16, further comprising a valve operably positioned between the hot fluid source and the thermal cavity, the valve operably controllable to supply hot fluid to the thermal cavity.

18. A gas turbine engine comprising:

a case configured to house components of the gas turbine engine;

a blade outer air seal support assembly comprising:

a blade outer air seal support having:

a support body defining an inner cavity;

at least one first support hook configured to engage with a blade outer air seal;

at least one second support hook configured to engage with a case hook of the case; and at least one loading hook within the inner cavity; and a thermal lifting member disposed within the inner cavity of the support body having:

a free floating, hollow body defining a thermal cavity therein, wherein the free-floating, hollow body is free-floating relative to the inner cavity of the support body when installed within the inner cavity of the support body;

at least one inlet fluid connector fluidly connected to the thermal cavity configured to supply hot fluid to the thermal cavity from a fluid source;

at least one outlet fluid connector fluidly connected to the thermal cavity configured to allow the hot fluid to exit the thermal cavity; and at least one lifting hook extending from the free-floating, hollow body and configured to engage with the at least one loading hook within the inner cavity of the support body, wherein the thermal lifting member is configured to thermally expand outward and freely move when hot fluid is passed through the thermal cavity such that during thermal expansion the at least one lifting hook applies force to the at least one loading hook to engage the blade outer air seal support and urge the blade outer air seal support radially outward; and a blade outer air seal engaged with the at least one first support hook of the blade outer air seal support.

19. The gas turbine engine of claim 18, further comprising one or more internal features within the thermal cavity configured to at least one of increase heat transfer within the hollow body or provide fluid flow augmentation within the thermal cavity.

20. A thermal lifting member for a blade outer air seal support of a gas turbine engine comprising:

a free-floating, hollow body defining a thermal cavity therein, wherein the free-floating, hollow body is free-floating when installed within the gas turbine engine;

at least one inlet fluid connector fluidly connected to the thermal cavity configured to supply hot fluid to the thermal cavity from a fluid source;

at least one outlet fluid connector fluidly connected to the thermal cavity configured to allow the hot fluid to exit the thermal cavity; and at least one lifting hook extending from the free-floating, hollow body and configured to engage with the blade outer air seal support, wherein the thermal lifting member is configured to thermally expand outward and freely move when hot fluid is passed through the thermal cavity such that during thermal expansion the at least one lifting hook engages the blade outer air seal support to urge the blade outer air seal support outward, wherein the at least one outlet fluid connector is positioned 180° from the at least one inlet fluid connector.

21. A thermal lifting member for a blade outer air seal support of a gas turbine engine comprising:

a free-floating, hollow body defining a thermal cavity therein, wherein the free-floating, hollow body is free-floating when installed within the gas turbine engine;

at least one inlet fluid connector fluidly connected to the thermal cavity configured to supply hot fluid to the thermal cavity from a fluid source;

at least one outlet fluid connector fluidly connected to the thermal cavity configured to allow the hot fluid to exit the thermal cavity; and at least one lifting hook extending from the free-floating, hollow body and configured to engage with the blade outer air seal support, wherein the thermal lifting member is configured to thermally expand outward and freely move when hot fluid is passed through the thermal cavity such that during thermal expansion the at least one lifting hook engages the blade outer air seal support to urge the blade outer air seal support outward, wherein the at least one inlet fluid connector comprises a first inlet fluid connector and a second inlet fluid connector and the at least one outlet fluid connector comprises a first outlet fluid connector and a second outlet fluid connector, wherein the first inlet fluid connector is positioned 180° from the second inlet fluid connector, wherein the first outlet fluid connector is positioned 180° from the second outlet fluid connector; and wherein the first inlet fluid connector is position 90° from the first outlet fluid connector.

22. A thermal lifting member for a blade outer air seal support of a gas turbine engine comprising:

a free-floating, hollow body defining a thermal cavity therein, wherein the free-floating, hollow body is free-floating when installed within the gas turbine engine, wherein the hollow body is circular;

at least one inlet fluid connector fluidly connected to the thermal cavity configured to supply hot fluid to the thermal cavity from a fluid source;

at least one outlet fluid connector fluidly connected to the thermal cavity configured to allow the hot fluid to exit the thermal cavity; and at least one lifting hook extending from the free-floating, hollow body and configured to engage with the blade outer air seal support, wherein the thermal lifting member is configured to thermally expand outward and freely move when hot fluid is passed through the thermal cavity such that during thermal expansion the at least one lifting hook engages the blade outer air seal support to urge the blade outer air seal support outward.

* * * * *